US010998125B2

(12) United States Patent
Ryu et al.

(10) Patent No.: US 10,998,125 B2
(45) Date of Patent: May 4, 2021

(54) COIL COMPONENT

(71) Applicant: SAMSUNG ELECTRO-MECHANICS CO., LTD., Suwon-si (KR)

(72) Inventors: Joung Gul Ryu, Suwon-si (KR); Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 67 days.

(21) Appl. No.: 16/291,429

(22) Filed: Mar. 4, 2019

(65) Prior Publication Data

US 2020/0027650 A1 Jan. 23, 2020

(30) Foreign Application Priority Data

Jul. 18, 2018 (KR) ..... 10-2018-0083389

(51) Int. Cl.

| | |
|---|---|
| ***H01F 5/00*** | (2006.01) |
| ***H01F 27/29*** | (2006.01) |
| ***H01F 27/30*** | (2006.01) |
| ***H01F 27/32*** | (2006.01) |

(52) U.S. Cl.

CPC ..... *H01F 27/29* (2013.01); *H01F 27/306* (2013.01); *H01F 27/323* (2013.01); *H01F 2027/297* (2013.01)

(58) Field of Classification Search

USPC ..... 336/200

See application file for complete search history.

(56) References Cited

U.S. PATENT DOCUMENTS 5,978,319 A * 11/1999 Wang ..... H01Q 7/00 369/13.23
8,514,539 B2 * 8/2013 Asakawa ..... H01F 17/0006 361/111
9,520,223 B2 12/2016 Yoo et al.
10,388,447 B2 8/2019 Choi et al.
(Continued)

FOREIGN PATENT DOCUMENTS

CN 104078221 A 10/2014
CN 105448503 A 3/2016
(Continued)

OTHER PUBLICATIONS

Chinese Office Action dated Dec. 18, 2020 issued in Chinese Patent Application No. 201910509199.3 (with English translation).

*Primary Examiner* — Ronald Hinson

(74) *Attorney, Agent, or Firm* — Morgan, Lewis & Bockius LLP

(57) ABSTRACT

A coil component includes a body including a coil and an external electrode disposed on an external surface of the body to be connected to the coil. The body includes a support member, disposed to support the coil, having a via hole spaced apart from a through-hole. The coil includes a coil body and a coil lead-out portion disposed to connect the coil body and the external electrode to each other. A first support layer is disposed between one surface of the support member and one surface of the coil lead-out portion, and a second support layer is disposed on the first support layer.

20 Claims, 2 Drawing Sheets

(56) References Cited

U.S. PATENT DOCUMENTS

| | | | | |
|---|---|---|---|---|
| 2005/0253677 | A1* | 11/2005 | Ito | H01F 17/0013 336/200 |
| 2013/0038417 | A1* | 2/2013 | Kim | H01F 17/0013 336/192 |
| 2013/0300529 | A1* | 11/2013 | Chang | H01F 27/292 336/173 |
| 2014/0285305 | A1* | 9/2014 | Yoo | H01F 27/022 336/200 |
| 2015/0270053 | A1* | 9/2015 | Cha | C25D 5/10 336/192 |
| 2016/0163444 | A1* | 6/2016 | Choi | H01F 17/04 336/200 |
| 2016/0189840 | A1* | 6/2016 | Ahn | H01F 17/0013 336/192 |
| 2017/0345556 | A1 | 11/2017 | Kim et al. | |
| 2018/0019051 | A1 | 1/2018 | Bong et al. | |

FOREIGN PATENT DOCUMENTS

| | | | |
|---|---|---|---|
| CN | 105742035 | A | 7/2016 |
| CN | 107622857 | A | 1/2018 |
| KR | 10-1999-0066108 | A | 8/1999 |
| KR | 10-2015-0033343 | A | 4/2015 |
| KR | 10-1832608 | B1 | 2/2018 |

* cited by examiner

COIL COMPONENT

CROSS-REFERENCE TO RELATED APPLICATION(S)

This application claims the benefit of priority to Korean Patent Application No. 10-2018-0083389 filed on Jul. 18, 2018 in the Korean Intellectual Property Office, the disclosure of which is incorporated herein by reference in its entirety.

TECHNICAL FIELD

The present disclosure relates to a coil component, and more particularly, to a thin-film power inductor.

BACKGROUND

As the miniaturization and thinning of various electronic devices have accelerated with the development of information technology (IT), thin-film inductors have also been required to be miniaturized and thinned. In the case of a power inductor, a chip size has decreased, but an increase in the number of turns of a coil pattern (fine patterning), the development of high-permeability materials, and a technique to increase a pattern height are required to achieve the miniaturization of products without the loss of chip characteristics such as inductance, Rdc, and the like.

SUMMARY

An aspect of the present disclosure is to provide a coil component having improved Rdc characteristics within a size of a miniaturized chip.

According to an aspect of the present disclosure, a coil component includes a body including a coil and an external electrode disposed on an external surface of the body to be connected to the coil. The body includes a support member disposed to support the coil. The coil includes a coil body and a coil lead-out portion disposed to electrically connect the coil body and the external electrode to each other. A first support layer and a second support layer are interposed between one surface of the support member and one surface of the coil lead-out portion, and the second support layer is disposed on the first support layer.

The coil may include a top coil, including a portion of the coil body, disposed on the one surface of the support member, and a bottom coil, including a portion of the coil body, disposed on another surface of the support member.

The top and bottom coils may be connected through a via filling a via hole of the support member. The via hole is disposed at one end of the coil and penetrating the top and bottom coils and the support member, and a through-hole penetrating a center of the support member is filled with an encapculant and spaced apart from the via hole.

Contact areas of The respective first and the second support layers are identical to each other.

An area of the first support layer in contact with the support member is larger than an area of the coil lead-out portion in contact with the second support layer.

Each of the plurality of strips extends from an outer end of the coil and is exposed to an external surface of the body, and the plurality of strips are spaced apart from each other and an insulating wall is interposed between adjacent strips of the coil lead-out portion.

The coil lead-out portion may have a structure in which a plurality of strips are combined.

The support member may have a thickness of 5 micrometers or more to 50 micrometers or less.

The first and second support layers may be exposed to an external surface of the body to be directly connected to the external electrode.

The first support layer may be a copper (Cu) metal layer.

The second support layer may be an invar alloy layer.

The second support layer may be a stainless steel layer.

The support member may be a glass-impregnated insulating layer.

The support member may be an insulating film.

The insulating film may include polyimide.

The coil may include a plurality of conductive layers.

Among the plurality of conductive layers, a lowest layer disposed closest to the support member may include at least one of nickel (Ni), titanium (Ti), molybdenum (Mo), copper (Cu), and niobium (Nb).

According to another aspect of the present disclosure, a coil component includes a body including a coil and an external electrode disposed on an external surface of the body to be connected to the coil. The body includes a support member disposed to support the coil. The coil includes a coil body and a coil lead-out portion disposed to electrically connect the coil body and the external electrode to each other. The body further includes two or more support layers, which are composed of different types of metals from each other, disposed between the coil lead-out portion and the support member.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
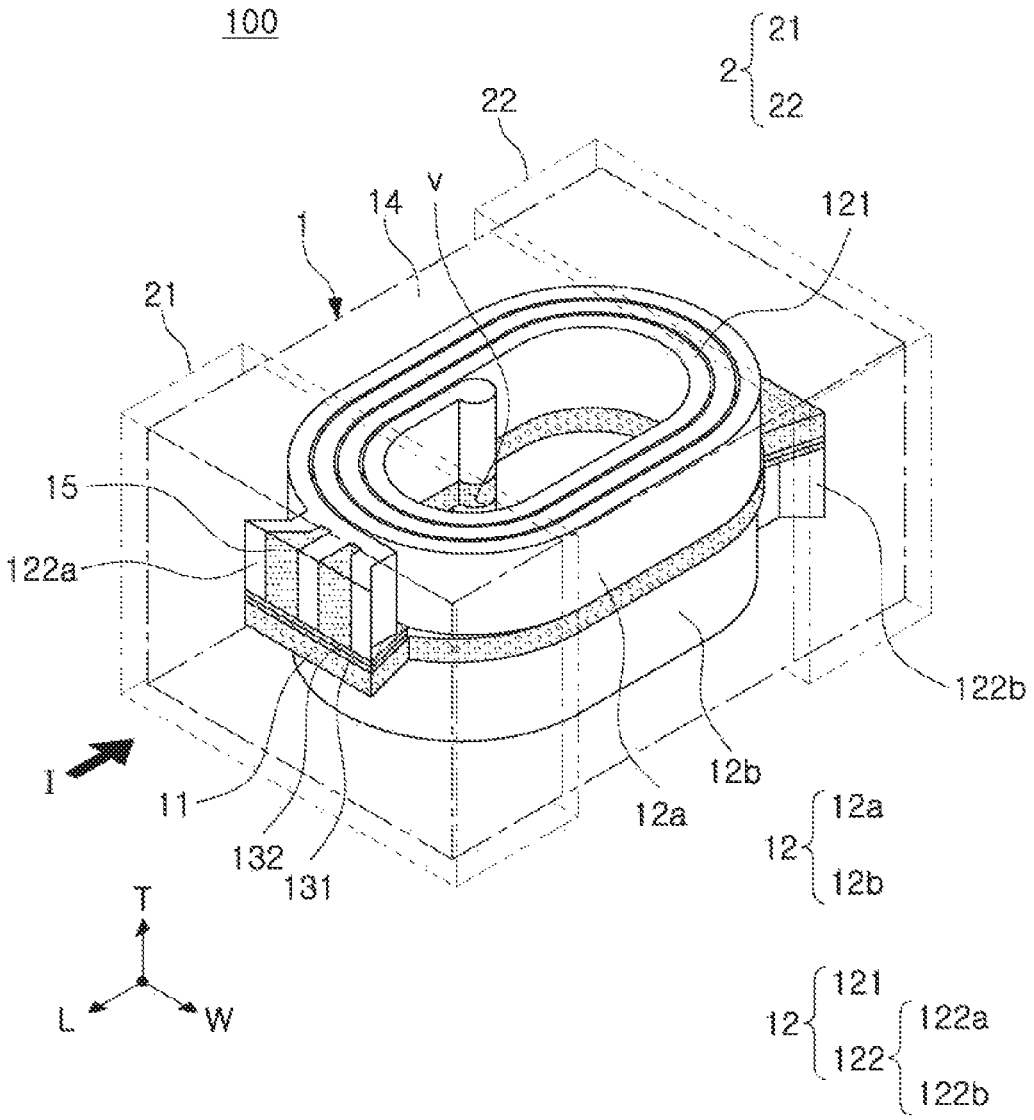
FIG. 1 is a perspective view of a coil component according to an exemplary embodiment in the present disclosure.

Hereinafter, examples of the present disclosure will be described as follows with reference to the attached drawings.

The present disclosure may, however, be embodied in many different forms and should not be construed as being limited to the examples set forth herein. Rather, these examples are provided so that this disclosure will be thorough and complete, and will fully convey the scope of the present disclosure to those skilled in the art.

The same reference numerals are used to designate the same elements throughout the drawings. In the drawings, the sizes and relative sizes of layers and regions may be exaggerated for clarity.

Hereinafter, a coil component according to an exemplary embodiment in the present disclosure will be described, but is not necessarily limited thereto.

Figure 2:
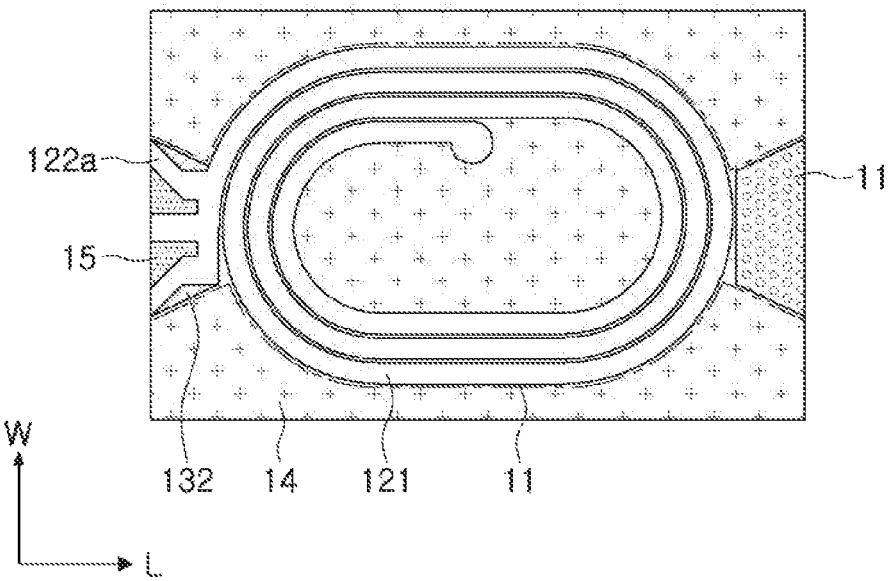
FIG. 2 is a plan view of FIG. 1.

FIG. 1 is a perspective view of a coil component 100 according to an exemplary embodiment in the present disclosure. FIG. 2 is a plan view of FIG. 1, and FIG. 3 is a plan view in direction I in FIG. 1.

Figure 3:
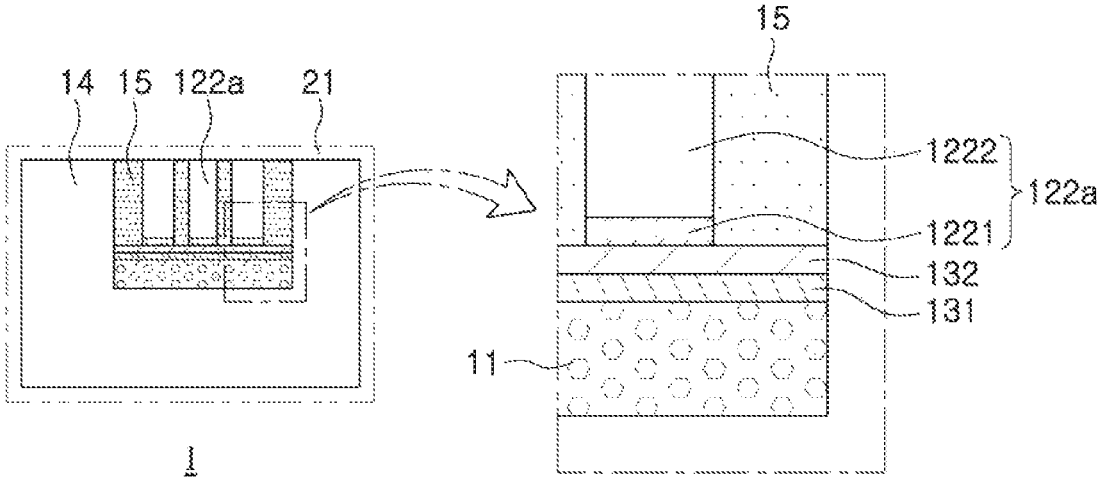
FIG. 3 is a plan view in direction I in FIG. 1.

Referring to FIGS. 1 to 3, the coil component 100 includes a body 1 and external electrodes 2.

The external electrodes 2 include a first external electrode 21 and a second external electrode 22 disposed on external surfaces of the body 1 to oppose each other in a length direction. Each of the external electrodes 21 and 22 has a shape extending from one surface to adjacent four surfaces of the body 1, but a shape thereof may be variously modified as needed by those skilled in the art. For example, each of the external electrodes 21 and 22 may have an "L" shape or an "I" shape. Since each of the external electrodes 21 and 22 is configured to be connected to a lead-out portion of an internal coil, each of the external electrodes 21 and 22 should include a material having improved electrical conductivity.

The body 1 has a substantially hexahedral shape having a first end surface and a second end surface disposed to oppose each other in a length direction L, a first side surface and a second side surface disposed to oppose each other in a width direction W, and a top surface and a bottom surface disposed to oppose each other in a thickness direction T.

The body 1 includes a support member 11, having a through-hole and a via hole, therein. The support member 11 serves to mechanically support a coil 12 and to facilitate formation of the coil 12.

The through-hole of the support member 11 is filled with an encapsulant 14 to be described later. Due to the encapsulant 14 filling the through-hole, permeation of the coil component 100 may be increased. The via hole is disposed to be spaced apart from the through-hole and is a space in which a via is to be formed to connect a top coil and a bottom coil to each other.

The support member 11 includes a material having insulating properties. The support member 11 may be a magnetic insulator having magnetic properties in addition to the insulating properties. For example, the support member 11 may include a resin and a glass filler impregnated in the resin. Alternatively, the support member 11 may be a pure insulating layer including only a resin without including a glass filler or the like. The support member 11 may be an insulating thin film. In this case, the insulating thin film may include a material such as a polyimide, and may be a film-type insulating layer applied to FCCL or the like. Further, the insulating thin film may be an Ajinomoto Build-up Film (ABF) or a PID resin available on the market.

A thickness of the support member 11 may be appropriately selected by those skilled in the art in consideration of a process environment and required characteristics. However, in detail, the thickness of the support member 11 may be significantly reduced to satisfy requirements such as a low profile and a high aspect ratio. The support member may 11 may have a thickness of, for example, 5 micrometers (μm) or more to 50 μm or less. In the case in which the support member 11 has a thickness less than 5 μm, there may be a limitation in securing mechanical strength necessary for the support member 11 to fully serve to support the coil 12. In the case in which the support member 11 has a thickness greater than 5 μm, there may be a limitation in reducing a size of a coil component.

The coil 12 is supported on the support member 11, and includes a top coil 12*a*, including a coil body 121 on one surface of the support member 11, and a bottom coil 12*b* including a coil body 121 on the other surface disposed to oppose the one surface of the support member 11. The top and bottom coils 12*a* and 12*b* are connected to each other through a via, filling a via hole V formed in the support member 11, to constitute a single coil.

The coil 12 includes a coil body 121 spirally wound and a coil lead-out portion 122 connected to both end portions of the coil body 121. The coil lead-out portion 122 includes a first lead-out portion 122*a* connected to the first external electrode 21 and a second lead-out portion 122*b* connected to the second external electrode 22.

First and second support layers 131 and 132 are further disposed between the first and second lead-out portions 122*a* and 122*b* and the support member 11. The second support layer 132 is disposed on the first support layer 131. The first support layer 131 and the second support layer 132 have the same cross-sectional shape when viewed from above on the basis of a thickness direction.

The first and second support layers 131 and 132 are sequentially laminated, but are formed of different materials from each other. Since the first and second support layers 131 and 132 include different types of metal, they are resistant to stress applied to the support member 11 to prevent a failure or low field between substrate processes. In this case, in detail, the different types of metal of the first and second support layers 131 and 132 have the same etchability. This is because in the case in which the different types of metal have the same etchability, cross-sectional shapes of the first and second support layers 131 and 132 may be secured, even when only a single process is applied.

As materials of the first and second support layers 131 and 132, applicable metals may be appropriately combined by those skilled in the art. However, considering that the first support layer 131 is a metal layer brought into direct contact with the support member 11, the first support layer 131 is, in detail, a copper (Cu) metal layer. On the other hand, the second support layer 132 may be an invar alloy layer or a stainless steel layer. Since invar is an iron-nickel alloy having a significantly low coefficient of thermal expansion (CTE), invar is suitable to prevent defects, such as warpage and the like, and low yield when a thin substrate process is performed on the support member 11.

Since the first and second support layers 131 and 132 form a double layer including different types of metal, there may be a significant resistance against stress applied to the support member 11 even when the support member 11 has a small thickness.

The thicknesses of the first and second support layers may be appropriately selected by those skilled in the art. However, it is to be noted that since the first and second support layers are not all disposed below a seed layer of the coil body 121, there may be a significant plating deviation between a plating process of the coil body and a plating process of the coil lead-out portion 122 when the first and second support layers 131 and 132 have significantly great thicknesses. In terms of the thicknesses of the first and second support layers 131 and 132, the sum of thicknesses of the first and second support layers 131 and 132 disposed on one surface of the support member 11, the thickness of the support member 11, and thicknesses of the first and second support layers 131 and 132 disposed on the other surface of the support member 11 is such that an existing apparatus may be used as it is. In detail, the total thickness has a deviation of 10 μm or less on the basis of 60 μm.

A cross-sectional shape of each of the first and second support layers 131 and 132 is not limited, but may be a trapezoidal shape as one side surface, on which the first and second support layers 131 and 132 are in contact with the external electrodes, is formed to have a length greater than a length of the other side surface disposed to oppose the one side surface. Since the first and second support layers 131 and 132 are exposed to the external surfaces of the body 1 and are directly connected to the external electrodes 21 and 22, a bonding area between an external electrode and a coil is increased when one side surface, on which the first and second support layers 131 and 132 are in contact with the external electrode, is formed to have a greater length. However, the cross-sectional shape of each of the first and second support layers 131 and 132 is not limited to a trapezoid, and may be any cross-sectional shape as long as it may appropriately support a coil lead-out portion 122. Therefore, the cross-sectional shape thereof may be a cross-sectional shape having a rectangle, a strip, or a curve.

The first and second lead-out portions 122*a* and 122*b* are disposed on the first and second support layers 131 and 132. The first lead-out portion 122*a* connects the first external electrode 21 and the coil body 121 to each other, and the second lead portion 122*b* connects the second external electrode 22 and the coil body 121 to each other. Each of the first and second lead-out portions 122*a* and 122*b* may have the same cross-sectional shape as each of the first and second support layers 131 and 132, but may have a plurality of strip shapes having a narrow line width to prevent overplating of the coil lead-out portion 122. When the first and second lead portions 122*a* and 122*b* are formed to have a plurality of strip shapes having a narrow line width, a variation in the plating thickness between the coil lead-out portion 122 and the coil body 121 may be reduced. However, it is a matter of course that the shape of the coil lead-out portion 122 may be appropriately designed and changed by those skilled in the art and that a thickness of the coil lead-out portion 122 may be relatively decreased while increasing a cross sectional of the coil lead-out portion 122 under the condition in which the coil lead-out portion 122 is formed to have a cross section smaller than a cross section of each of the first and second support layers 131 and 132. In this case, a type of plating liquid or a concentration of the plating liquid may be appropriately designed and changed to adjust plating growth rates of the coil body 121 and the coil lead-out portion 122.

Referring to FIG. 3, the coil 12 includes a plurality of conductive layers at the first and second lead-out portions 122*a* and 122*b*. Since the coil 12 includes a coil body 121 and a coil lead-out portion 122 which are integrated into a single body, a combination of the plurality of conductive layers of the coil body 121 is substantially the same as a combination of the plurality of conductive layers of the coil lead-out portion 122. However, since the first and second support layers 131 and 132 are interposed between the coil lead-out portion 121 and the support member 11, a position of a lowest layer, among the plurality of conductive layers of the coil lead-out portion 122, is higher than a position of a lowest layer among the plurality of conductive layers of the coil body 121. To this end, it is necessary to perform a process of coating the first and second support layers 131 and 132 on the entirety of one surface and the other surface of the support member 11 by sputtering or the like, respectively, and a process of removing the first and second support layers 131 and 132 except for a peripheral region of a position, in the coil-lead portion 122 is disposed, by etching or the like. During an etching process of determining external shapes of the first and second support layers 131 and 132, the degree of etching may be appropriately set by those skilled in the art. However, in detail, the first and second support layers 131 and 132 do not extend inwardly of a through-hole H of the support member 11 to sufficiently secure permeability of a coil core. For example, the entire through-hole H has a structure filled with an encapsulant rather than the first and second support layers 131 and 132.

A plurality of conductive layers constituting a coil will be described in detail with reference to FIG. 3. In a coil lead-out portion 122, a first lead-out portion 122*a* brought into direct contact with the first external electrode 21 is shown in FIG. 3. The first lead-out portion 122*a* includes a plurality of conductive layers. Among the plurality of conductive layers, a lowest layer 1221 disposed closest to the support member 11 may be a seed layer. A method of forming the seed layer is not limited. However, in detail, a sputtering process is applied in the case of the present disclosure. In a related art, when a seed layer is formed using a sputtering process, a uniform thin metal film may be obtained. On the other hand, since an affinity between an insulating material constituting the support member 11 and a metal material applied to the sputtering is decreased, delamination of a coil or the like may occur. However, in the case of the present disclosure, the first and second support layers 131 and 132 may be interposed between the support member 11 and the coil lead-out portion such that an affinity of materials may be improved to prevent delamination of a coil or the like.

The lowest layer 1221 may include at least one of nickel (Ni), titanium (Ti), molybdenum (Mo), copper (Cu), and niobium (Nb). The lowest layer 1221 may include a plurality of layers, such as a Ni—Mo layer or a Ni—Cu layer, rather than a single layer. A material having improved adhesiveness to a metal of the second support layer 132, brought into contact with a bottom surface of the lowest layer, is disposed below the lowest layer, and a material having improved adhesiveness to a metal of the plating layer, brought into contact with a top surface of the lowest layer, is disposed above the lowest layer. As a result, adhesion may be sufficiently secured on both the top and bottom surfaces of the lowest layer.

A plating layer 1222 is disposed on the lowest layer 1221 to substantially determine an ultimate thickness of the coil. A method of forming the plating layer 1222 is not limited, and the plating layer 1222 may be formed using the lowest layer as a seed layer. A cross-sectional shape of the plating layer 1222 may be rectangular. To this end, an insulating wall 15 including a patterned opening serving as a plating growth guide may be disposed on the lowest layer, and a plating layer may fill in the opening. An aspect ratio AR of the coil may be stably increased by the insulating wall. Although FIG. 3 shows the insulating wall 15 remaining unremoved, it is a matter of course that the insulating wall 15 may be removed after a plating layer (not shown) is completed. In this case, it is a matter of course that a separate insulating layer should be formed to achieve insulation between adjacent coils.

According to an exemplary embodiment, a coil component includes a chip having a limited thickness. By increasing a thickness of a coil pattern within the limited thickness of the chip, a delamination between different types of material may be prevented while improving Rdc characteristics of a coil in the coil component.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil; and an external electrode disposed on an external surface of the body to be connected to the coil, wherein the body includes a support member disposed to support the coil, the coil includes a coil body and a coil lead-out portion disposed to electrically connect the coil body and the external electrode to each other, and a first support layer and a second support layer are interposed only between one surface of the support member and one surface of the coil lead-out portion in a thickness direction, and the second support layer is disposed on the first support layer.

2. The coil component of claim 1, wherein the support member has a thickness ranging from 5 micrometers to 50 micrometers.

3. The coil component of claim 1, wherein the first and second support layers are exposed to an external surface of the body to be directly connected to the external electrode.

4. The coil component of claim 1, wherein the first support layer is a copper (Cu) metal layer.

5. The coil component of claim 1, wherein the second support layer is an invar alloy layer.

6. The coil component of claim 1, wherein the second support layer is a stainless steel layer.

7. The coil component of claim 1, wherein the support member is a glass-impregnated insulating layer.

8. The coil component of claim 1, wherein the support member is an insulating film, and wherein the insulating film includes polyimide.

9. The coil component of claim 1, wherein the coil includes a top coil, including a portion of the coil body, disposed on the one surface of the support member, and a bottom coil, including a portion of the coil body, disposed on another surface of the support member.

10. The coil component of claim 9, wherein the top and bottom coils are connected through a via filling a via hole of the support member, the via hole being disposed at one end of the coil and penetrating the top and bottom coils and the support member, and a through-hole penetrating a center of the support member is filled with an encapculant and spaced apart from the via hole.

11. The coil component of claim 1, wherein the first and second support layers have same shapes as each other when view from above in the thickness direction.

12. The coil component of claim 11, wherein an area of a portion of the first support layer, directly below the coil lead-out portion in the thickness direction, in contact with the support member is larger than an area of the coil lead-out portion in contact with the second support layer.

13. The coil component of claim 1, wherein the coil lead-out portion has a structure in which a plurality of strips are combined.

14. The coil component of claim 13, wherein each of the plurality of strips extends from an outer end of the coil and is exposed to an external surface of the body, and the plurality of strips are spaced apart from each other and an insulating wall is interposed between adjacent strips of the coil lead-out portion.

15. The coil component of claim 1, wherein the coil includes a plurality of conductive layers.

16. The coil component of claim 15, wherein among the plurality of conductive layers, a lowest layer disposed closest to the support member includes at least one of nickel (Ni), titanium (Ti), molybdenum (Mo), copper (Cu), and niobium (Nb).

17. A coil component comprising:

a body including a coil; and an external electrode disposed on an external surface of the body to be connected to the coil, wherein the body includes a support member disposed to support the coil, the coil includes a coil body and a coil lead-out portion disposed to electrically connect the coil body and the external electrode to each other, and the body further includes two or more support layers, which are composed of different types of metals from each other, disposed only between the coil lead-out portion and the support member in a thickness direction.

18. The coil component of claim 17, wherein the two or more support layers have same shapes as each other when view from above in the thickness direction.

19. The coil component of claim 18, wherein an area of a portion of the two or more support layers, directly below the coil lead-out portion in the thickness direction, in contact with the support member is larger than an area of the coil lead-out portion in contact with the two or more support layers.

20. A coil component comprising:

a body including a coil; and an external electrode disposed on an external surface of the body to be connected to the coil, wherein the body includes a support member disposed to support the coil, the coil includes a coil body and a coil lead-out portion disposed to electrically connect the coil body and the external electrode to each other, at least one support layer is interposed between one surface of the support member and one surface of the coil lead-out portion, the coil lead-out portion has a structure in which a plurality of strips are combined, each of the plurality of strips extends from an outer end of the coil and is exposed to an external surface of the body, and the plurality of strips are spaced apart from each other and an insulating wall is interposed between adjacent strips of the coil lead-out portion.

* * * * *